US011730663B2

(12) United States Patent
Van Der Merwe et al.

(10) Patent No.: US 11,730,663 B2
(45) Date of Patent: Aug. 22, 2023

(54) NECK AND UPPER BACK MASSAGE DEVICE

(71) Applicants: Stephanus Van Der Merwe, San Marcos, CA (US); Lee-Anne Stossell, San Marcos, CA (US); Jay R. Huhn, Carlsbad, CA (US)

(72) Inventors: Stephanus Van Der Merwe, San Marcos, CA (US); Lee-Anne Stossell, San Marcos, CA (US); Jay R. Huhn, Carlsbad, CA (US)

( * ) Notice: Subject to any disclaimer, the term of this patent is extended or adjusted under 35 U.S.C. 154(b) by 425 days.

(21) Appl. No.: 16/988,522

(22) Filed: Aug. 7, 2020

(65) Prior Publication Data

US 2021/0038467 A1 Feb. 11, 2021

Related U.S. Application Data

(60) Provisional application No. 62/885,308, filed on Aug. 11, 2019.

(51) Int. Cl.
*A61H 15/00* (2006.01)
*A61H 7/00* (2006.01)

(52) U.S. Cl.
CPC ..... *A61H 15/0078* (2013.01); *A61H 7/004* (2013.01); *A61H 2015/0028* (2013.01); *A61H 2201/1215* (2013.01); *A61H 2205/04* (2013.01)

(58) Field of Classification Search
CPC . A61H 1/00; A61H 1/008; A61H 7/00; A61H 7/007; A61H 2007/009; A61H 23/00; A61H 23/02; A61H 23/006; A61H 23/0254; A61H 15/00; A61H 2015/0007; A61H 2015/0014; A61H 2015/0021; A61H 2015/0028; A61H 2015/0134; A61H 2015/0138; A61H 2201/0119; A61H 2201/0138; A61H 2201/0142; A61H 2201/0146; A61H 2201/0207; A61H 2201/0149; A61H 2201/0157; A61H 2201/0134; A61H 2201/1215; A61H 2201/123; A61H 2201/1623; A61H 2201/1671; A61H 2201/5035; A61H 2201/5002; A61H 2201/1669; A61H 2201/1609; A61H 15/0078; A61H 7/004; A61H 2205/04; A61H 2205/062; A61H 2205/081; A61H 2203/0456
See application file for complete search history.

(56) References Cited

U.S. PATENT DOCUMENTS

| | | | | |
|---|---|---|---|---|
| 5,695,451 | A * | 12/1997 | Kawakami | A61H 23/0254 601/134 |
| 6,440,091 | B1 * | 8/2002 | Hirosawa | A61H 7/00 601/93 |
| 7,081,099 | B1 * | 7/2006 | Luo | A61H 7/00 601/134 |
| 2016/0008210 | A1 * | 1/2016 | Chen | A61H 7/007 601/98 |
| 2021/0161753 | A1 * | 6/2021 | Switzer | A61H 7/007 |
| 2022/0000706 | A1 * | 1/2022 | Grbic | A61H 15/00 |

* cited by examiner

*Primary Examiner* — Timothy A Stanis
*Assistant Examiner* — Matthew R Moon
(74) *Attorney, Agent, or Firm* — Eric Hanscom

(57) ABSTRACT

A massaging device with linearly adjustable nodes that conform to different bodies and treatment regimens, capable of simultaneously massaging both the neck and upper back of a user. The device requires no effort or force on the part of the user to hold the device in position or to apply pressure.

6 Claims, 13 Drawing Sheets

NECK AND UPPER BACK MASSAGE DEVICE

CROSS REFERENCE TO RELATED APPLICATIONS

This utility patent application claims priority back to U.S. Provisional No. 62/885,308, entitled "Neck and Upper Back Massage Device", with a filing date of Aug. 11, 2019 the same inventors as with this application, the contents of which are incorporated by reference into this document.

STATEMENT REGARDING FEDERALLY SPONSORED RESEARCH OR DEVELOPMENT

This invention was not federally sponsored.

BACKGROUND OF THE INVENTION

Field of the Invention

This invention relates to the general field of therapeutic devices, and more specifically to a portable massage device that can be laid on the floor or any other flat surface to function, where the massage device provides massage relief in a novel and unique manner through lateral movement of the massaging nodes. This combination suboccipital and upper trapezius massage device works passively on a user and requires no assistance from another person and no requirement for force or effort from the user.

Massage has been proven to be one of the best ways to fix a number of health challenges, particularly for users who deal with neck and back pain. While beneficial, massage therapy can be prohibitively expensive, with some massage practitioners charging upwards of $100/hour. Thus, for those without medical insurance that covers massage, affording the very treatment that is most likely to relieve their ailments can be a challenge.

The economics of human massage has resulted in massaging machines becoming very popular. There are current a wide variety of massaging chairs, massaging mats, and massaging machines that provide a variety of massages. None of these devices, however, provides an effective massage at a reasonable price.

For example, there are neck and shoulder massaging devices that can be placed around a user's neck. These devices, however, either require a second person to help operate the device, or depend upon the user to pull down on the device to affect the treatment. Obviously if a user has to hire a second person to work the machine, the savings over a human massage are less than optimum. At the same time, if the user has to supply the downward pressure so that the machine actually reaches the desired area of treatment, the user's arm muscles are far from relaxed, thereby rendering the "treatment" less than optimally effective.

There are "massage mats" that can be placed between a person's back and a chair, or upon which a user can lie down. These mats, though, are basically flat, two-dimensional devices and do not adequately reach the occiput(neck) and trapezius(shoulders) muscles for effective therapeutic massage.

Another weakness in the prior art is that there is not a device that can massage both the neck and upper back simultaneously. In common cases such as whiplash and "tech neck", both the neck and upper back are in need of massage treatment.

Thus, there has existed a long-felt need for a passive, combination suboccipital and upper trapezius massage device.

The current invention provides just such a solution by providing a passive massaging device capable of simultaneously massaging both the neck and upper back of a user, without needing any additional helpers and without need the user to apply effort or force to the device. The massage device has linearly adjustable nodes that conform to different bodies and treatment regimens for the upper back, and a multiple node circular massager for the neck regions.

This invention is relatively small, compact, and easy to transport, and yet provides both suboccipital and upper trapezius massage abilities. It is effective in treating both neck and upper back pain simultaneously. Among its benefits are decreasing tension headaches and stress, reducing upper back pain, neck pain and stiffness, and massaging hard-to-reach muscles in the neck and upper back. Users of the invention have also found that they have better sleep, and that the device helps them to accelerate muscle recovery, alleviate muscle pain, and to increase flexibility and circulation.

By way of reference the upper trapezius muscle is a postural and active movement muscle, used to tilt and turn the head and neck, shrug, steady the shoulders, and twist the arms. The trapezius elevates, depresses, rotates, and retracts the scapula, or shoulder blade. upper (or descending) fibers of the trapezius originate from the spinous process of C7, the external occipital protuberance, the medial third of the superior nuchal line of the occipital bone (both in the back of the head), and the ligamentum nuchae. From this origin they proceed downward and laterally to be inserted into the posterior border of the lateral third of the clavicle. The levator scapulae elevates and rotates the scapula. The levator scapulae elevates and rotates the inferior angle medially, when the spine is fixed. When the unilateral shoulder is fixed the levator scapulae rotates the scapulae to the same side and flexes the spine laterally.

OBJECTS OF THE INVENTION

It is therefore an object of the present invention to provide a portable massage device that can be used on any flat surface.

Another object of the invention is to provide a massage device that allows for lateral movement of the massaging nodes.

A further object of the invention is to provide a device that can simultaneously massage the suboccipital and upper trapezius regions.

Another object of the invention is to provide an effective, inexpensive, and easy-to-use massage device for the neck and upper shoulders that can be used by individuals using the device at home without any medical supervision.

An additional object of the invention is to provide a massager that massages with a trapezius node rotating in only one direction with a lateral motion that is reciprocal for kneading shiatsu massage.

A final object of the invention is to provide a massage device that works passively on a user and requires no assistance from another person and no requirement for force or effort from the user.

There has thus been outlined, rather broadly, the more important features of the invention in order that the detailed description thereof may be better understood, and in order that the present contribution to the art may be better appreciated. There are additional features of the invention that will be described hereinafter, and which will form the subject matter of the claims appended hereto. The features listed herein, and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

BRIEF DESCRIPTION OF THE FIGURES

One preferred form of the invention will now be described with reference to the accompanying drawings.

DETAILED DESCRIPTION OF THE FIGURES

Figure 1:
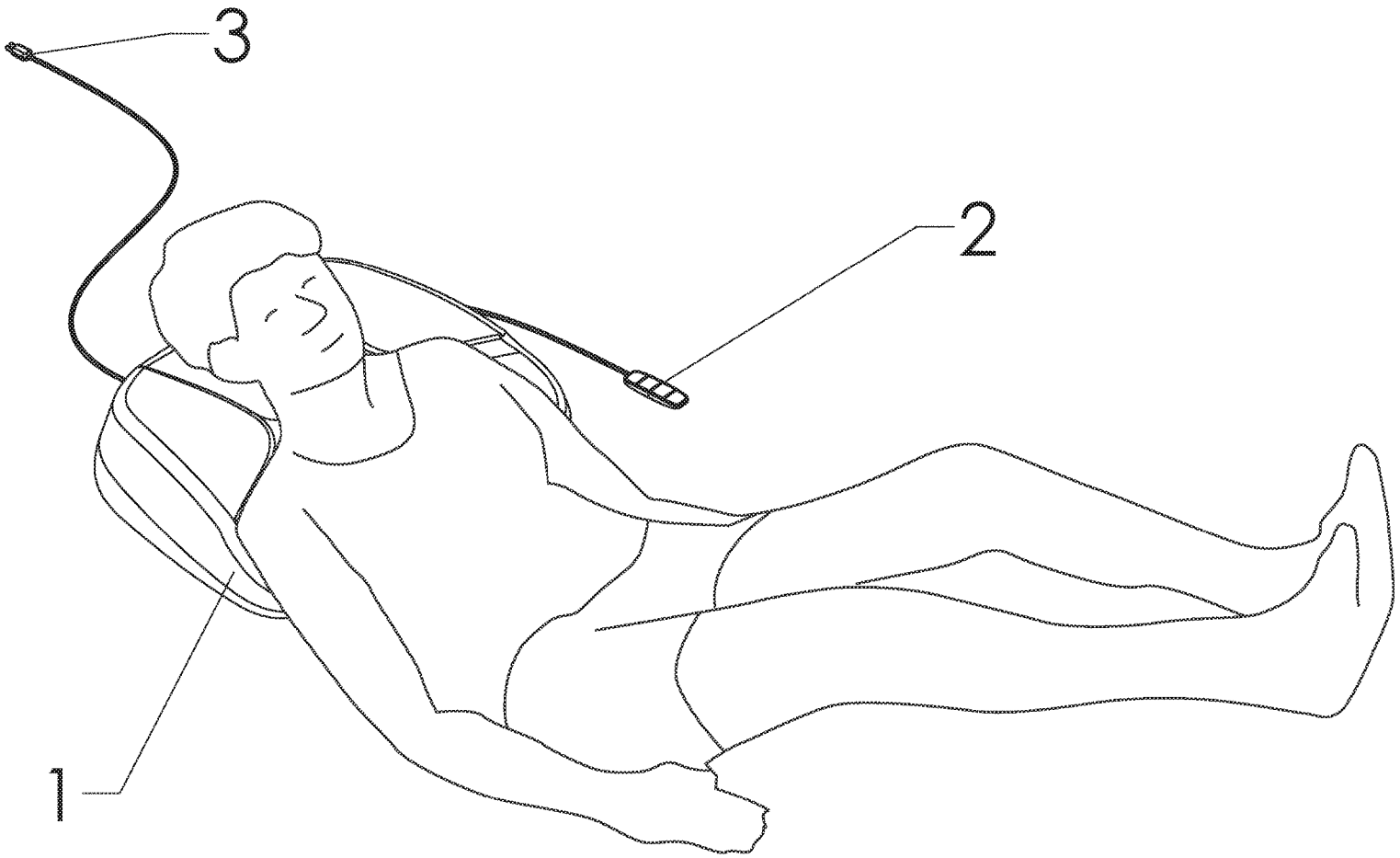
FIG. 1 is a perspective view of a person resting on the massage device.

Many aspects of the invention can be better understood with references made to the drawings below. The components in the drawings are not necessarily drawn to scale. Instead, emphasis is placed upon clearly illustrating the components of the present invention. Moreover, like reference numerals designate corresponding parts through the several views in the drawings. Before explaining at least one embodiment of the invention, it is to be understood that the embodiments of the invention are not limited in their application to the details of construction and to the arrangement of the components set forth in the following description or illustrated in the drawings. The embodiments of the invention are capable of being practiced and carried out in various ways. In addition, the phraseology and terminology employed herein are for the purpose of description and should not be regarded as limiting.

FIG. 1 is a perspective view of a person resting on the massage device. The person lies flat on the ground or other flat object and places the invention under his/her neck and upper back. The person's weight presses down on the massaging nodes such that the person does not need to pull or push on anything to bring the invention in pressurized contact with the areas to be massaged. The device 1 is a small, roughly rectangular massager that conveniently rests under the neck and upper back of the user. An electrical plug can be plugged into an electrical outlet while the duration and intensity of massagers is controlled with a hand-held remote 2 that can communicate with the massaging device directly or wirelessly.

Figure 2:
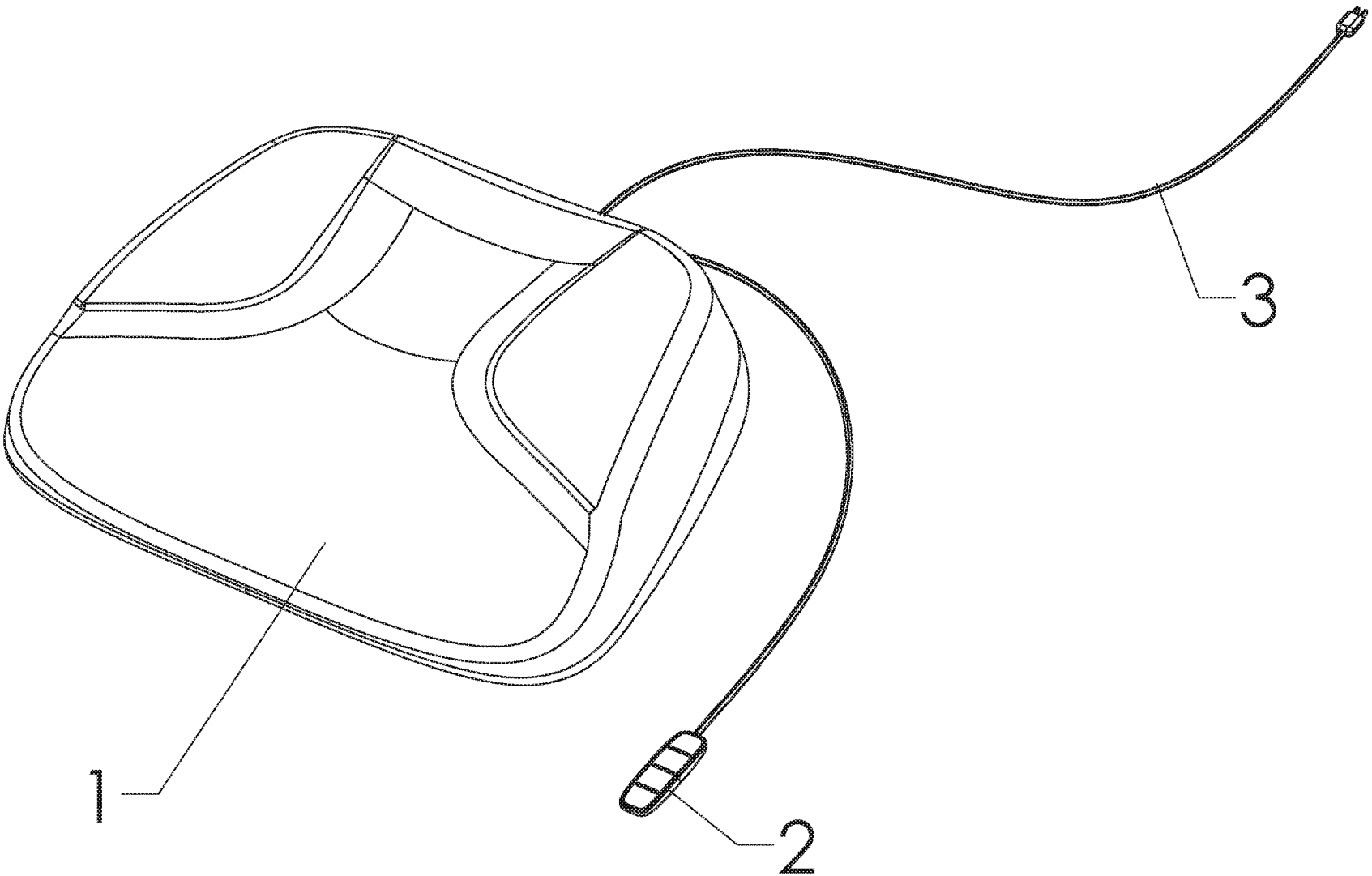
FIG. 2 is a perspective view of the External Device Assembly.

FIG. 2 is a perspective view of the External Device Assembly showing the device 1, the electrical connection 3 and the remote controller 2. As can be appreciated from this view, the device is small enough to be portable, such that a user is not physically limited to a treatment room at a user's home, but rather can take the device wherever he/she goes. It is also contemplated that a wireless connection to the massaging device could be used.

Figure 3:
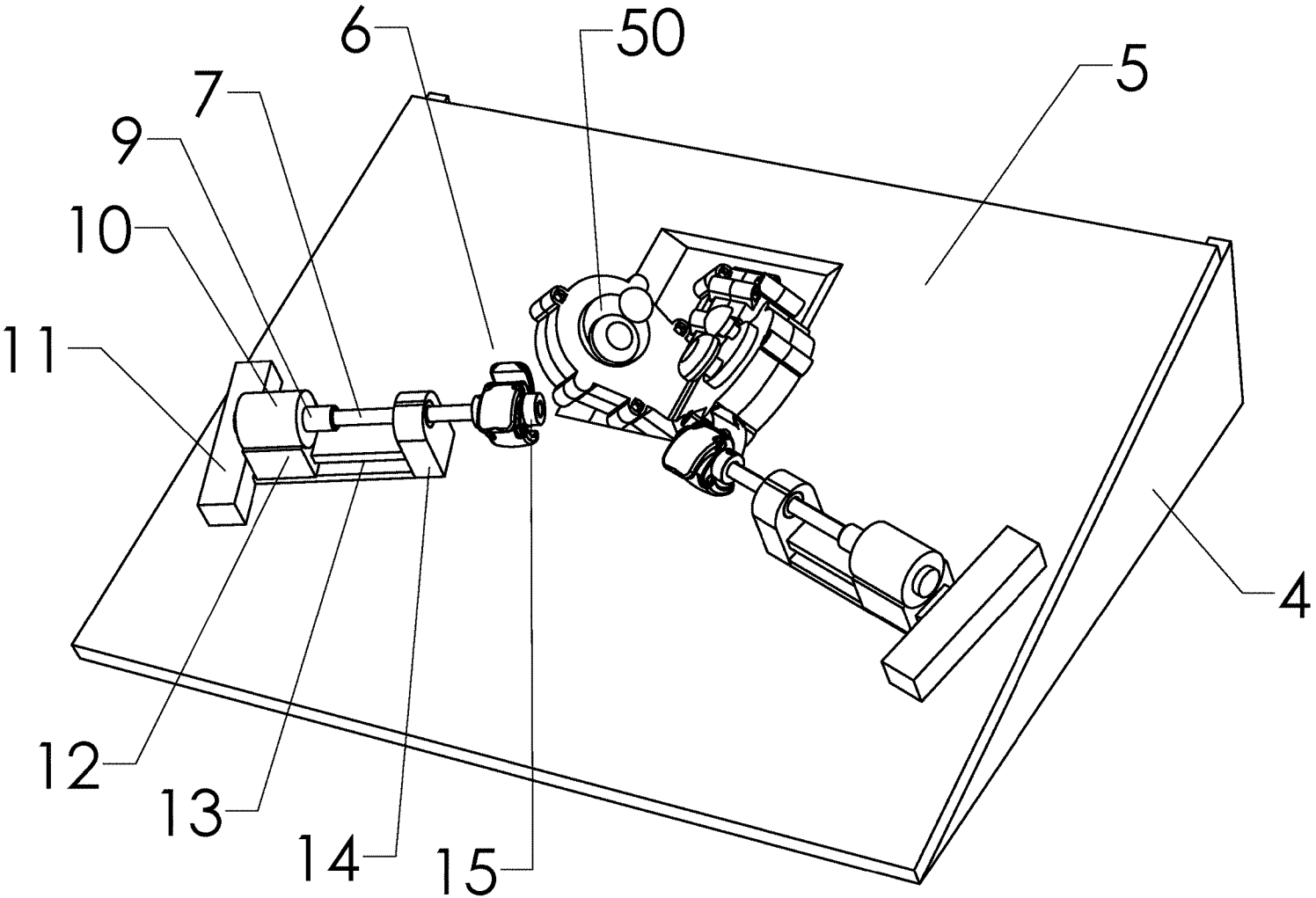
FIG. 3 is a perspective view of the interior machinery of the device.

FIG. 3 is a perspective view of the interior machinery of the device. The interior machinery is housed in an angled base 4, 5, to which a soft cover is attached which protects the user against the hard parts of the device. The device has an Occiput Assembly or Neck Massager, referenced generally as 20, for massaging the neck, with two Occipital Nodes Assemblies 6 are angled 90 degrees for neck massage. For massaging the upper back and shoulders, the device also has two Trapezius Motion Sub-Assemblies, or Upper Back Massagers, generally referenced as 21: one on either side of the occiput assembly. It is contemplated that the various components may have adjustable angles to compensate for different sized users and different treatments desired.

In terms of functionality, the neck massager 20 has two Occipital Node Assemblies 20, angled away from each other by 90 degrees. This offset allows for a superior massaging of the neck region. On either side of the neck massager 20 are two Back Massagers 21. Each back massager 21 has a trapezius node 6, that is the actual massaging portion. The trapezius node is linearly movable back and forth along an axle 8 to allow for back and shoulder massaging at exactly the correct point, and to allow for different treatment areas to be accessed. A set screw assembly 15 holds the trapezius node 6 on the axle 7. A shaft adaptor 9 connects the axle 7 to a rotary motor 10 which is supported by a motor mount 12 and connected to a linear actuator 11. A slide rail 13 and axle holder 14 support the device. As the rotary motor 10 rotates the trapezius node 6, the linear actuator 11 determines where on the axle 8 the trapezius node 6 will be doing its massaging.

Figure 4:
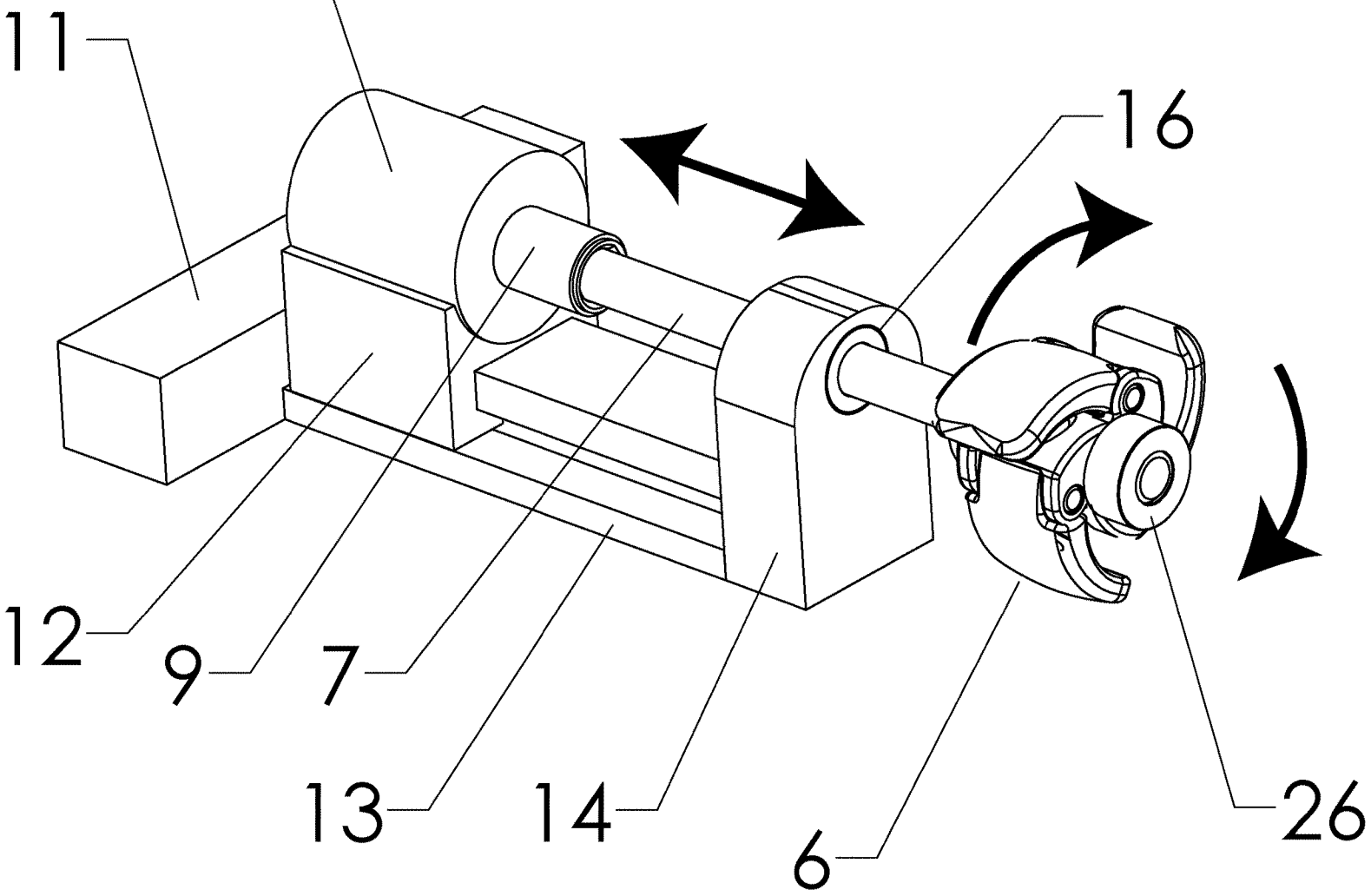
FIG. 4 is a perspective view of the shoulder massaging portion of the device.

FIG. 4 is a perspective view of the shoulder massaging portion 21 of the device. The distance of the trapezius node 6 can be configured for multiple size users via the linear actuator 11 to accommodate different neck and trapezius widths on the user. Once the user's preferred mirrored node distance is determined, the rotary of the trapezius node can be activated (one direction). Once the rotary action is activated, the linear actuator reactivates to during rotary motion to move the axis back and forth up to 1-inch to move the nodes back and forth on axis to provide a variable trapezius massage. An axis bearing 16 allows for smooth rotation of the axle 8.

Figure 5:
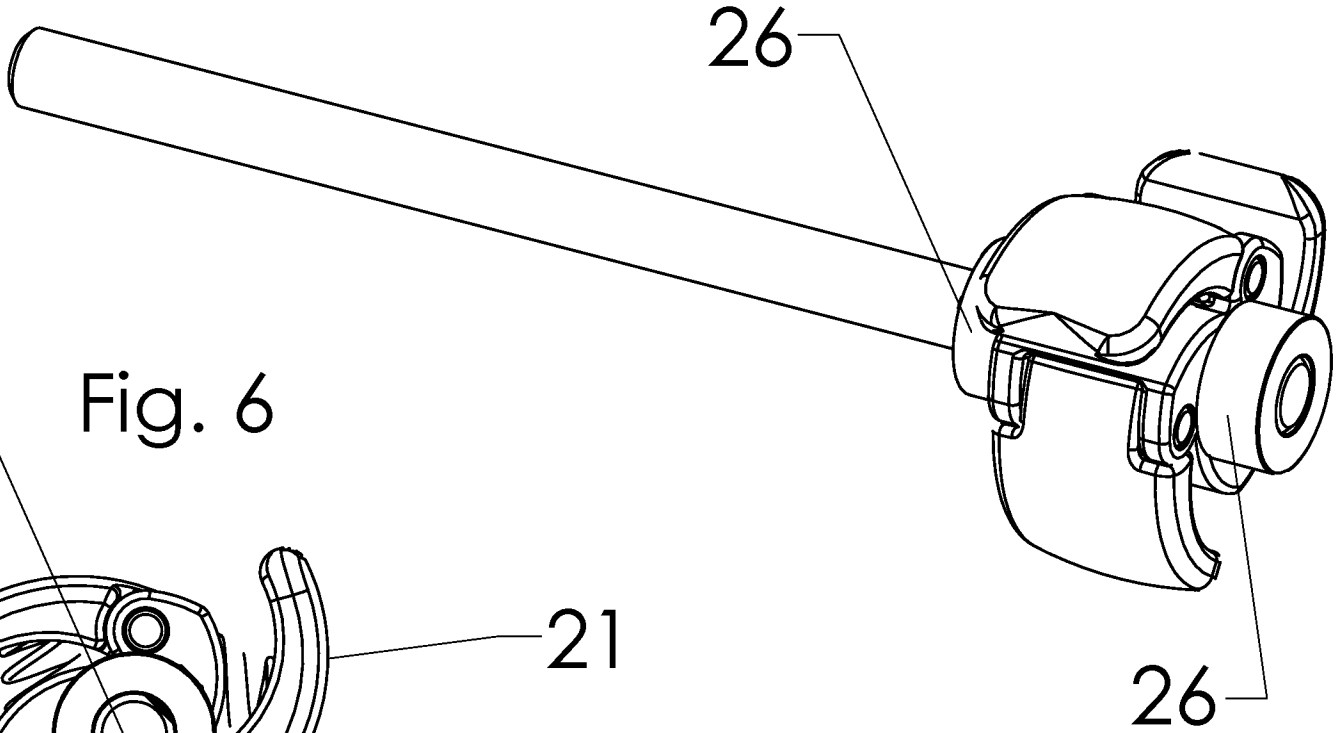
FIG. 5 is a perspective view of the shoulder massaging portion of the device with the trapezius node in a far-extended location.

FIG. 5 is a perspective view of the shoulder massaging portion of the device with the trapezius node 6 in a far-extended location along the axle 7. A set screw assembly 15 holds the trapezius node 6 in its desired location so that it can rotate at that location and deliver a massage to the proper location on a user.

Figure 6:
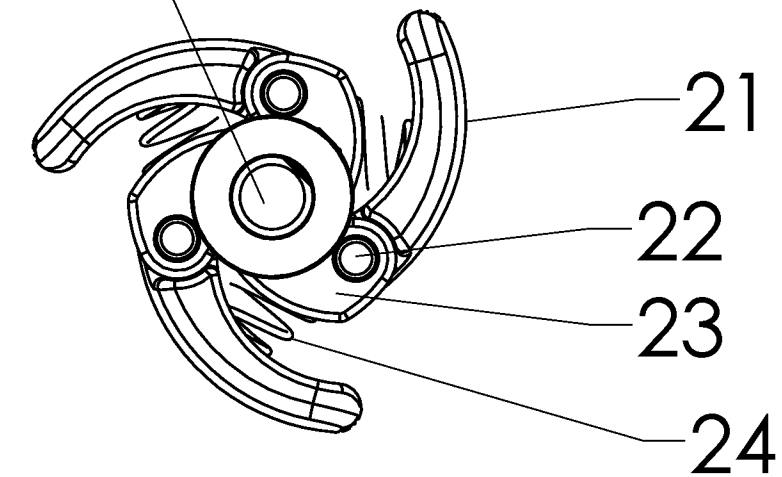
FIG. 6 is a side view of the trapezius node portion of the invention.

FIG. 6 is a side view of the trapezius node portion 6 of the invention. The trapezius node 6 is comprised of three curved plates (22) that are secured to the central node base 18 by a node pin 17. A node spring 19 provides tension against the curved plates 22 to keep them putting pressure on user. These nodes are rotated on axle 7 in one direction only. A set screw assembly, 26, holds the node unit to the axle.

Figure 7:
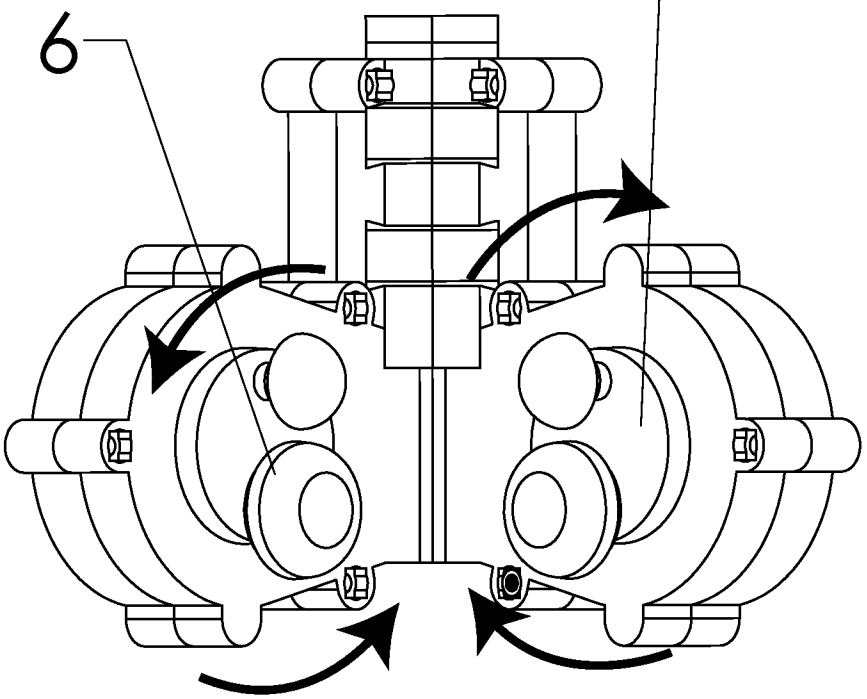
FIG. 7 is a front, perspective view of the occiput node portion of the invention.

FIG. 7 is a front, perspective view of the occiput node portion 20 of the invention. The occipital nodes 6 rotate in opposing directions, the neck massager 20 has two Occipital Node Assemblies 6, angled away from each other by 90 degrees, held in place by the neck massager base 23. This offset allows for a superior massaging of the neck region.

Figure 8:
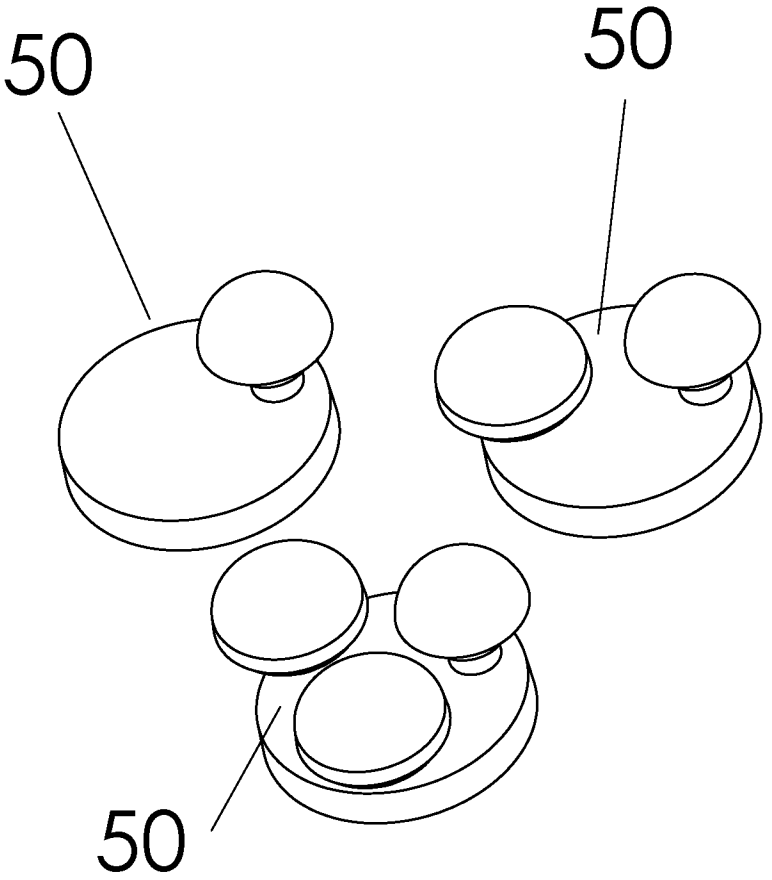
FIG. 8 shows perspective views of several options for the Occipital Node Assembly portion of the invention.

FIG. 8 shows perspective views of several options for the Occipital Node Assembly portion of the invention. is a front, perspective view of the occiput node portion of the invention, with 1, 2, or 3 nodes, generally referenced as 50 showing the different node configurations.

Geared motors provide between 12 kg and 15 kg torque. Independent reciprocal drive with positional sensors for multiple programmable modes of independent manual position setting. Alternatively, there can be a direct bevel gear drive for a simpler version. Alternatively, dual independent nod drive motor for more intelligent programmable modes, for example, left-only or right-only trap massage.

Figure 9:
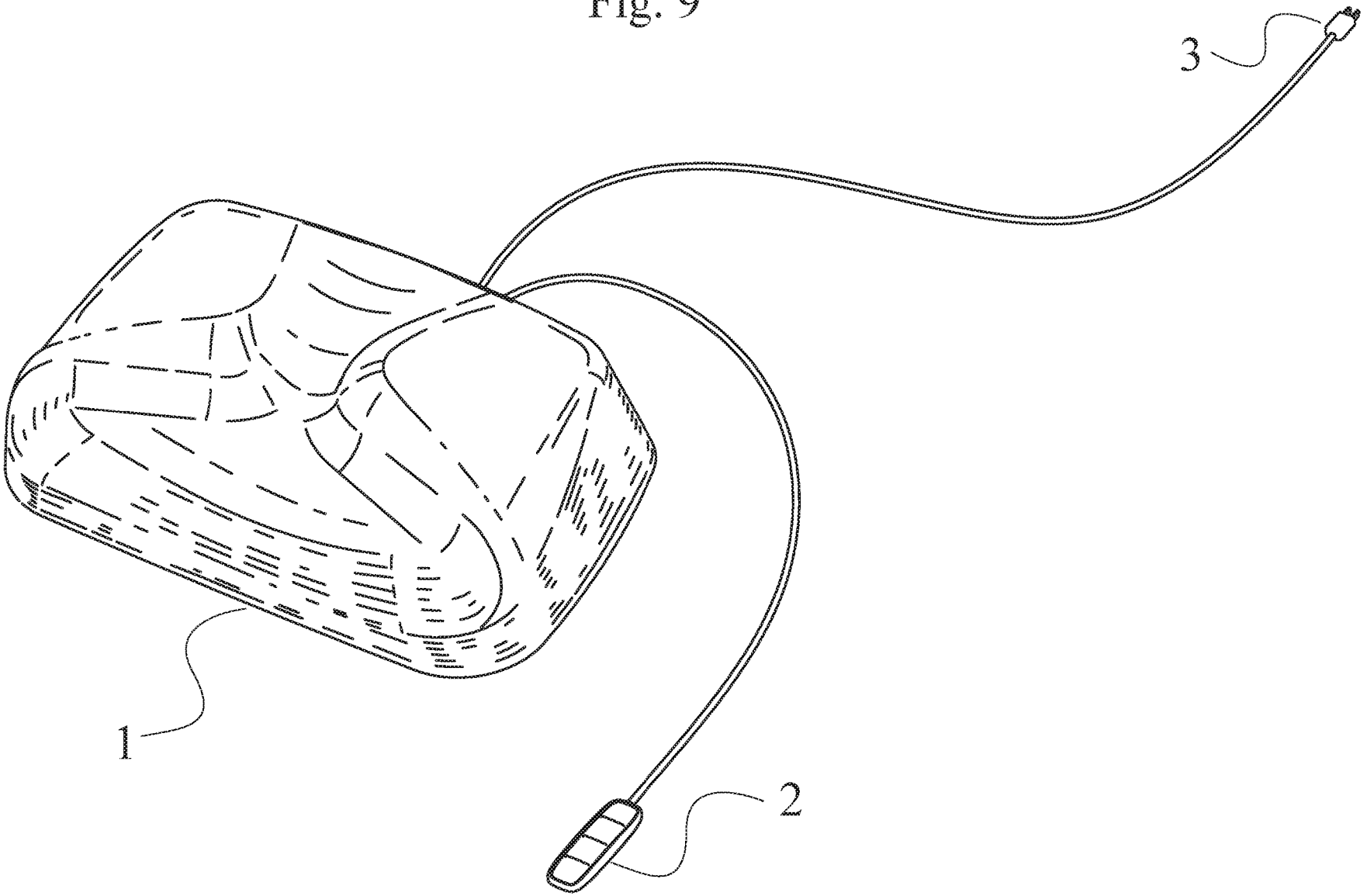
FIG. 9 is a perspective view of a second embodiment of the External Device Assembly.

FIG. 9 is a perspective view of a second embodiment of the External Device Assembly. This figure shows the device 1, the electrical connection 3 and the remote controller 2.

Figure 10:
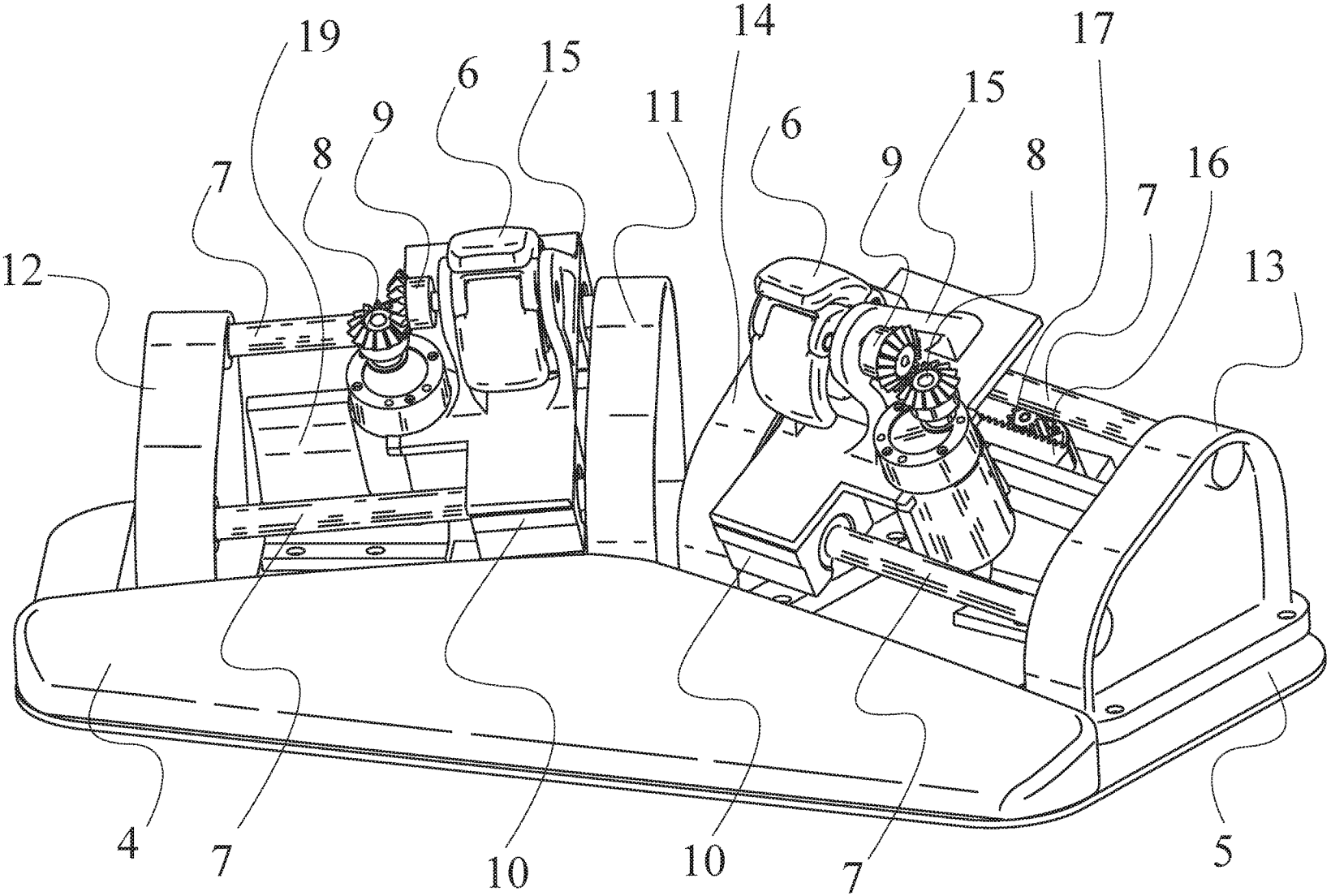
FIG. 10 is a perspective view of the interior machinery a second embodiment of the device.

FIG. 10 is a perspective view of the interior machinery a second embodiment of the device. The interior machinery is housed in an angled front support 4, and a floor base 5, to which a soft cover is attached which protects the user against the hard parts of the device. The device has an Occiput Assembly or Neck Massager for massaging the neck, with two Occipital Nodes Assemblies 6 are angled 90 degrees for neck massage. It is contemplated that the various components may have adjustable angles to compensate for different sized users and different treatments desired.

In terms of functionality, the neck massager has two Occipital Node Assemblies 6, angled away from each other by 90 degrees. This offset allows for a superior massaging of the neck region. The node assemblies 6 can move laterally along two reciprocal shafts 7, which are stabilized by a Left Outside Shaft Holder 12, a Left Inside Shaft Holder 11, a Right Inside Shaft Holder 14, and a Right Outside Shaft Holder 13. A linear gear 16 is driven by a reciprocal motor assembly with gear 17 moves the node assemblies back and forth along the reciprocal shafts 7, supported by a linear gear support 19.

Shaft carriage assemblies 10 have holes through with the reciprocal shafts 7 pass. On each node assembly 6, a node motor and gear assembly 8 and a node gear shaft assembly 9 control the movement of the node assembly 6, with support from a node shaft support 15

Figure 11:
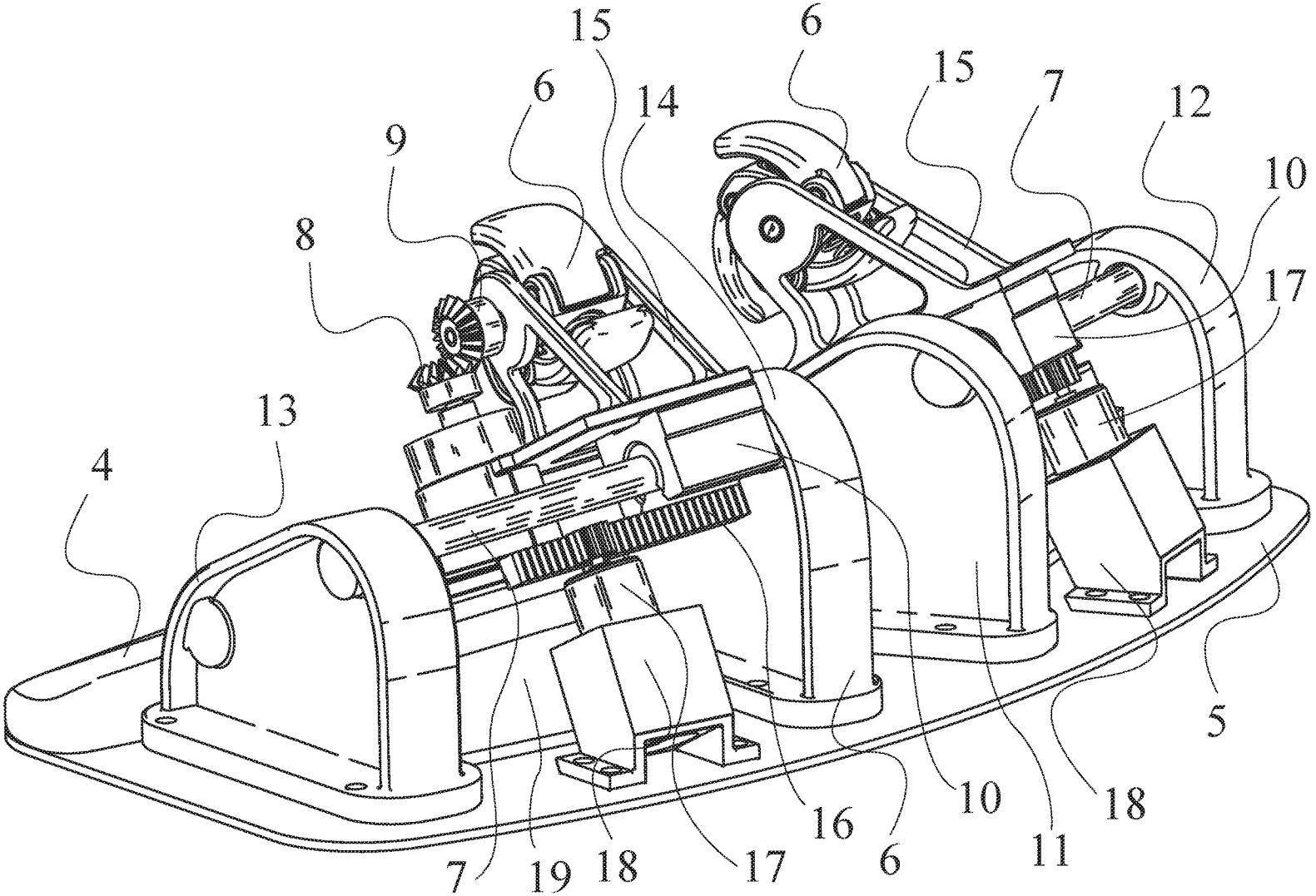
FIG. 11 is a back perspective view of the interior machinery a second embodiment of the device.
Figure 12:
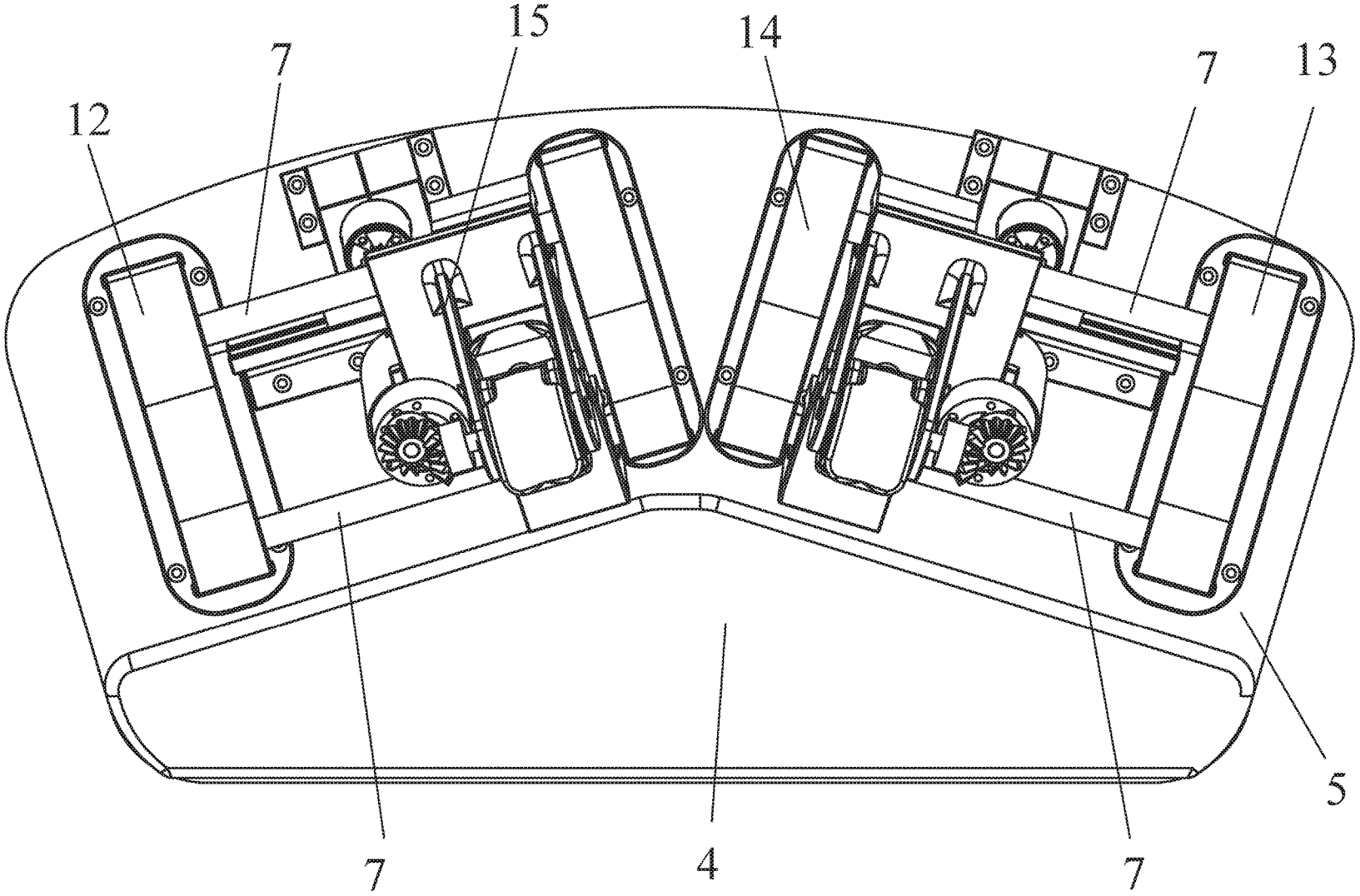
FIG. 12 is a top perspective view of the interior machinery a second embodiment of the device.

FIG. 11 is a back perspective view of the interior machinery a second embodiment of the device. Visible in this figure are the reciprocal motor supports 18, FIG. 12 is a top perspective view of the interior machinery of a second embodiment of the device.

Figure 13:
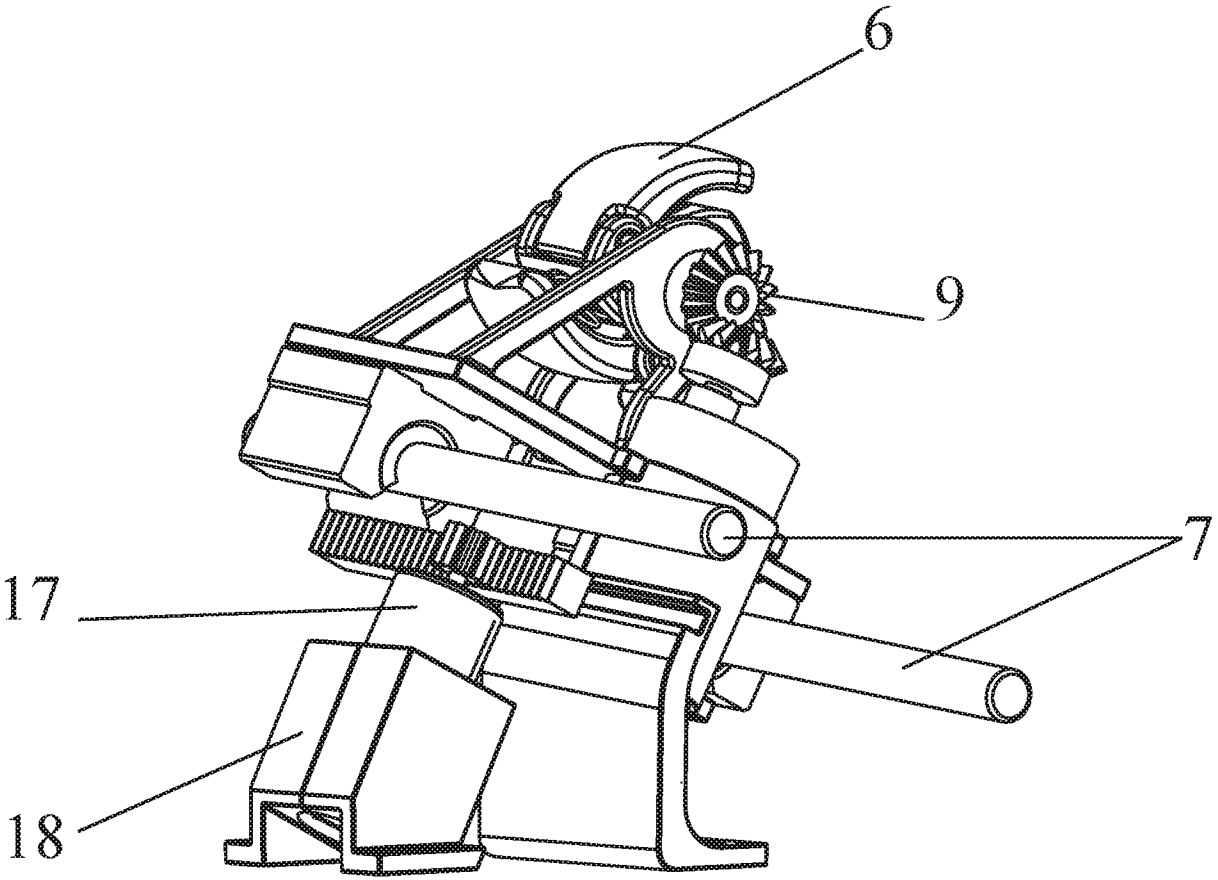
FIG. 13 is a side perspective view of the interior machinery of a second embodiment of the device.

FIG. 13 is a side perspective view of the interior machinery of a second embodiment of the device.

Figure 14:
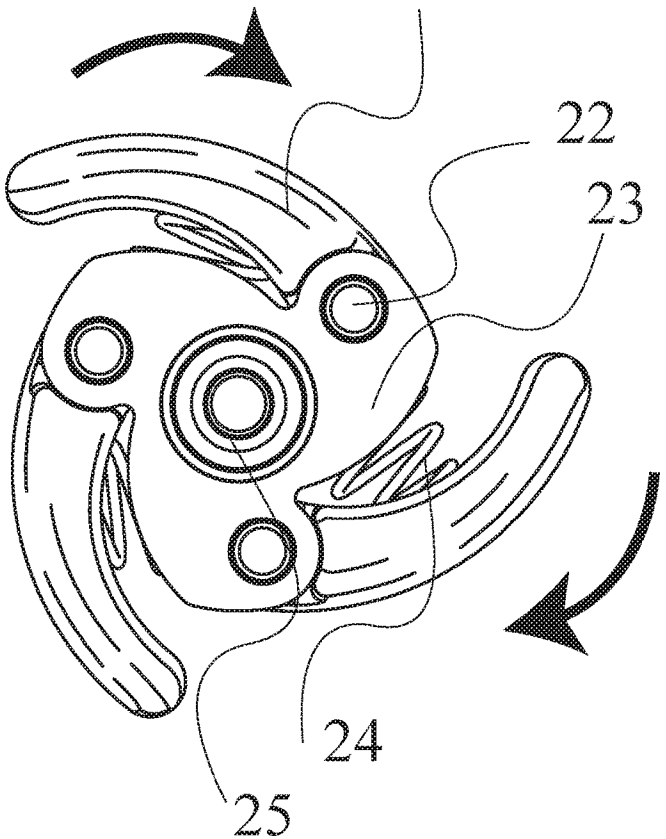
FIG. 14 is a front view of the trapezius node portion of the invention.

FIG. 14 is a front view of the trapezius node portion of the invention. The node shaft 20 holds the unit around a node bearing 25, about which it rotates. The actually massaging device consists of three trapezius nodes 21 rotating around three node pins 22, with a node spring 24 providing support for the massaging device.

Figure 15:
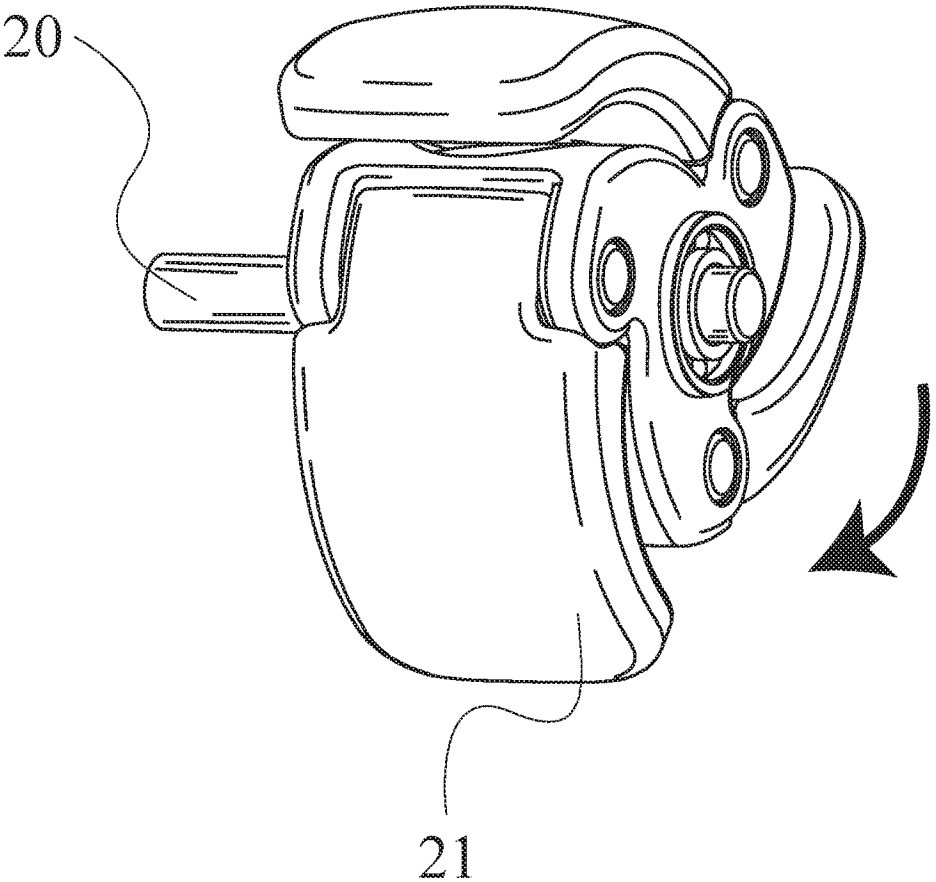
FIG. 15 is a side view of the trapezius node portion of the invention.

FIG. 15 is a side view of the trapezius node portion of the invention.

Figure 16:
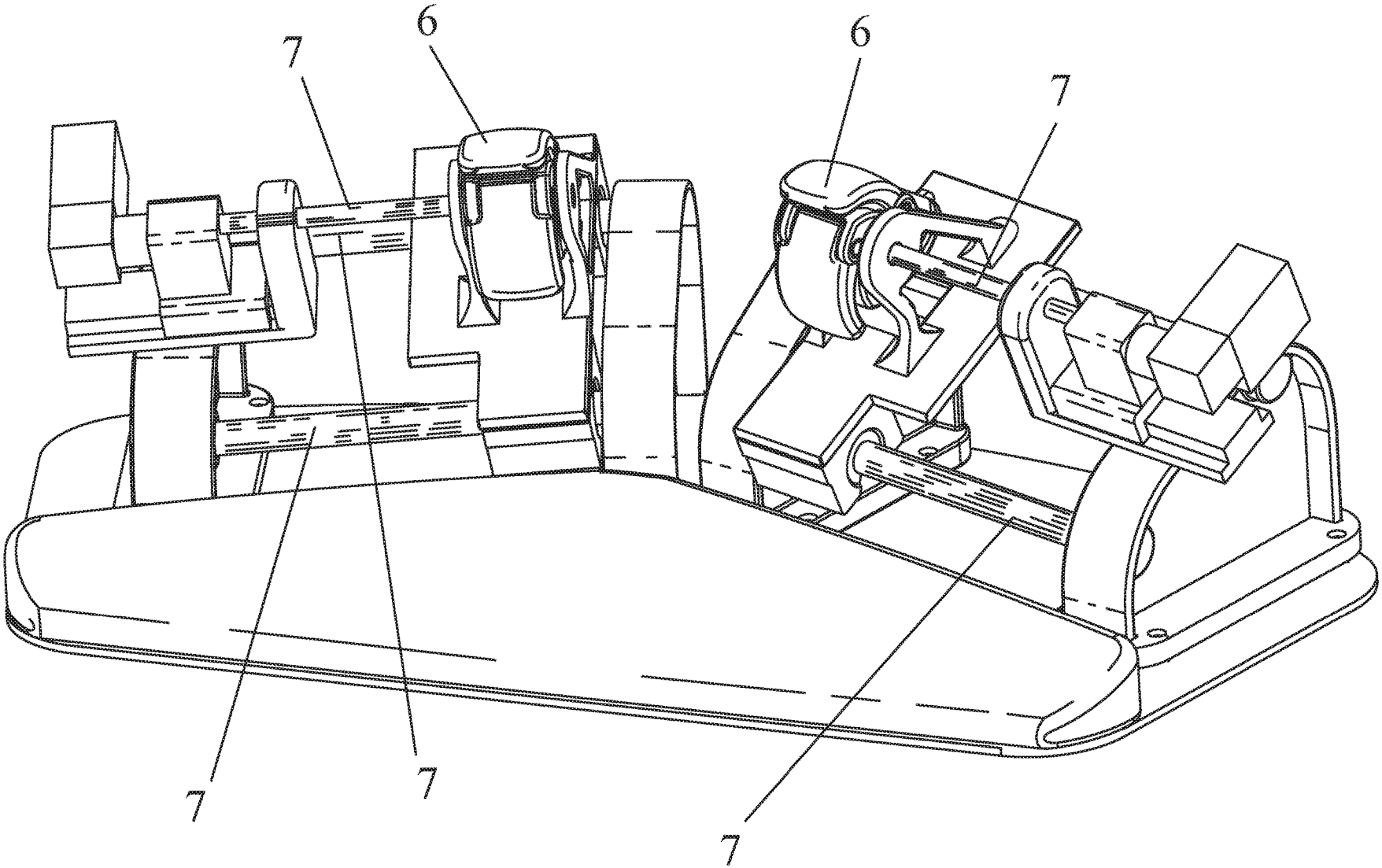
FIG. 16 is a back perspective view of the interior machinery a second embodiment of the device.

FIG. 16 is a back perspective view of the interior machinery a second embodiment of the device.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

That which is claimed:

1. A device for massaging the neck of a person, comprising:

a controller and a massager, wherein the controller consists of an electric plug, a body, and a remote control, wherein a person manipulates the body to have the remote control send a signal to the massager, and wherein the signal can vary one or more attributes of the massager, wherein the massager consists of a front support and a floor base, two node assemblies, wherein the two node assemblies are offset to one another by an angle, and wherein the angle is 90 degrees, and wherein each node assembly is slidably retained by a shaft carriage assembly, a linear gear support, a reciprocal motor support, and a node shaft support along two reciprocal shafts, wherein each of the two reciprocal shafts is retained by an outer shaft holder and an inner shaft holder, wherein a location of each node assembly is controlled by a linear gear and a reciprocal motor assembly with gear, wherein each node assembly consists of a node shaft, which is connected to the node gear shaft assembly, a node bearing, wherein the node bearing connects the node assembly to the node shaft, three trapezius nodes, which are tensionally opposed against a node core of the node assembly, and wherein each of the three trapezius nodes rotates around a node pin, wherein each node assembly is capable of rotation, and wherein the rotation is controlled by a node motor and gear assembly, a node gear shaft assembly, wherein a location along the reciprocal shaft, a speed of rotation, and sequence of rotation, and duration of rotation are controlled by the controller.

2. The device of claim 1, wherein each node assembly additionally comprises one or more node heads, wherein each of the one or more node heads has a stem section and a head section, wherein the stem section connects the head section to the node assembly.

3. The device of claim 2, wherein at least one of the head sections of the one or more node heads has a half-spherical shape.

4. The device of claim 3, wherein there are at least two node heads, and wherein the at least two node heads have a node head shape, and wherein the node head shape of the at least two node heads is identical to the node head shape of the other node heads of the at least two node heads.

5. The device of claim 3, wherein there are at least two node heads, and wherein the at least two node heads have a node head shape, and wherein the node head shape of the at least two node heads is not identical to the node head shape of the other node heads of the at least two node heads.

6. A device for massaging the neck of a person, consisting of:

a controller and a massager, wherein the controller consists of an electric plug, a body, and a remote control, wherein a person manipulates the body to have the remote control send a signal to the massager, and wherein the signal can vary one or more attributes of the massager, wherein the massager consists of a front support and a floor base, two node assemblies, wherein the two node assemblies are offset to one another by an angle, and wherein the angle is 90 degrees, and wherein each node assembly is slidably retained by a shaft carriage assembly, a linear gear support, a reciprocal motor support, and a node shaft support along two reciprocal shafts, wherein each of the two reciprocal shafts is retained by an outer shaft holder and an inner shaft holder, wherein a location of each node assembly is controlled by a linear gear and a reciprocal motor assembly with gear wherein each node assembly consists of a node shaft, which is connected to the node gear shaft assembly, a node bearing, wherein the node bearing connects the node assembly to the node shaft, three trapezius nodes, which are tensionally opposed against a node core of the node assembly, and wherein each of the three trapezius nodes rotates around a node pin, wherein each node assembly is capable of rotation, and wherein the rotation is controlled by a node motor and gear assembly, a node gear shaft assembly, wherein a location along the reciprocal shaft, a speed of rotation, and sequence of rotation, and duration of rotation are controlled by the controller, wherein each node assembly additionally comprises one or more node heads, wherein each of the one or more node heads has a stem section and a head section, wherein the stem section connects the head section to the node assembly, wherein at least one of the head sections of the one or more node heads has a half-spherical shape, wherein there are at least two node heads, and wherein the at least two node heads have a node head shape, and wherein the node head shape of the at least two node heads is not identical to the node head shape of the other node heads of the at least two node heads.

* * * * *